US009688941B2

(12) United States Patent
Sakanoue et al.

(10) Patent No.: US 9,688,941 B2
(45) Date of Patent: Jun. 27, 2017

(54) LUBRICATING OIL COMPOSITION FOR SHOCK ABSORBER

(71) Applicant: IDEMITSU KOSAN CO., LTD., Chiyoda-ku (JP)

(72) Inventors: Shuichi Sakanoue, Chiba (JP); Aya Aoki, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/910,883

(22) PCT Filed: Aug. 25, 2014

(86) PCT No.: PCT/JP2014/072120
§ 371 (c)(1),
(2) Date: Feb. 8, 2016

(87) PCT Pub. No.: WO2015/025973
PCT Pub. Date: Feb. 26, 2015

(65) Prior Publication Data

US 2016/0194578 A1 Jul. 7, 2016

(30) Foreign Application Priority Data

Aug. 23, 2013 (JP) ..... 2013-173922

(51) Int. Cl.

| | |
|---|---|
| ***C10M 157/00*** | (2006.01) |
| ***C10M 169/04*** | (2006.01) |
| ***C10M 145/14*** | (2006.01) |
| ***C10M 101/02*** | (2006.01) |
| ***C10M 105/04*** | (2006.01) |
| ***C10M 105/06*** | (2006.01) |
| ***C10M 105/32*** | (2006.01) |

(52) U.S. Cl.
CPC ..... *C10M 169/041* (2013.01); *C10M 101/02* (2013.01); *C10M 105/04* (2013.01); *C10M 105/06* (2013.01); *C10M 105/32* (2013.01); *C10M 145/14* (2013.01); *C10M 2203/1006* (2013.01); *C10M 2203/1025* (2013.01); *C10M 2205/0285* (2013.01); *C10M 2205/223* (2013.01); *C10M 2207/2805* (2013.01); *C10M 2209/084* (2013.01); *C10N 2220/021* (2013.01); *C10N 2220/022* (2013.01); *C10N 2230/68* (2013.01); *C10N 2230/74* (2013.01); *C10N 2240/08* (2013.01)

(58) Field of Classification Search
CPC ..... C10M 2209/084
USPC ..... 508/473
See application file for complete search history.

(56) References Cited

U.S. PATENT DOCUMENTS

| | | | | |
|---|---|---|---|---|
| 4,857,220 | A | 8/1989 | Hashimoto | |
| 2004/0077585 | A1 | 4/2004 | Peterson et al. | |
| 2007/0259792 | A1* | 11/2007 | Null | C10M 105/04 508/583 |
| 2009/0005273 | A1 | 1/2009 | Swartele et al. | |
| 2014/0011724 | A1 | 1/2014 | Onumata et al. | |

FOREIGN PATENT DOCUMENTS

| | | | |
|---|---|---|---|
| EP | 0625180 | | 11/1994 |
| EP | 0992570 | | 4/2000 |
| JP | 63-280797 | A | 11/1988 |
| JP | 2000-44971 | A | 2/2000 |
| JP | 2000-109876 | A | 4/2000 |
| JP | 2000-109877 | A | 4/2000 |
| JP | 2008-248204 | A | 10/2008 |
| JP | 2012-201808 | A | 10/2012 |
| WO | 93/16152 | | 8/1993 |

OTHER PUBLICATIONS

International Search Report Issued Oct. 7, 2014 in PCT/JP2014/072120 Filed Aug. 25, 2014.
Supplementary European Search Report issued May 4, 2017 issued in connection with corresponding European Patent Application No. 14838269, Aug. 25, 2014.

* cited by examiner

*Primary Examiner* — Vishal Vasisth
(74) *Attorney, Agent, or Firm* — Oblon, McClelland, Maier & Neustadt, L.L.P.

(57) ABSTRACT

Provided is a lubricating oil composition for a shock absorber, which realizes excellent riding comfort in low-temperature and high-temperature environments and can suppress worsening of riding comfort with time, which is caused by evaporation and shearing of the lubricating oil. The lubricating oil composition for a shock absorber contains (A) a base oil having a pour point of lower than −40° C. and a kinematic viscosity at 80° C. of from 2.0 to 2.7 $mm^2/s$, (B-1) from 1 to 15% by mass of a polymethacrylate having a weight-average molecular weight of from 10,000 to less than 100,000, and (B-2) from 0.1 to 5% by mass of a polymethacrylate having a weight-average molecular weight of from 100,000 to 200,000.

12 Claims, No Drawings

LUBRICATING OIL COMPOSITION FOR SHOCK ABSORBER

This application is a 371 of PCT/JP2014/072120, filed Aug. 25, 2014.

TECHNICAL FIELD

The present invention relates to a lubricating oil composition for a shock absorber. More precisely, the present invention relates to a lubricating oil composition suitable for a shock absorber that constitutes the suspension of an automobile body.

BACKGROUND ART

A shock absorber is installed between the body and the tire of an automobile such as motorcycles, cars, etc., and acts to reduce the vibration of the car body caused by road surface roughness, the shaking thereof to occur in quick acceleration or sudden braking, and the like.

In the expansion and contraction movement of the shock absorber, the vibration is relaxed owing to the resistance force to be generated when a lubricating oil passes through the valve arranged inside the shock absorber. The viscosity characteristics of lubricating oil have a significant influence on the resistance force and eventually on the riding comfort of automobiles. Regarding the viscosity characteristics of lubricating oil, therefore, both the viscosity increase at low temperatures and the viscosity reduction at high temperatures are desired to be small.

Recently, sale of luxury cars has become in great demand in Mideast and Russia. In Mideast, the lubricating oil temperature in a shock absorber rises up to about 80° C., while in Russia, it lowers to about −40° C. Accordingly, the improvement of the viscosity characteristics of lubricating oil mentioned above is an important theme.

When the increase in the viscosity of lubricating oil at low temperatures is intended to be suppressed, the lubricating oil tends to vaporize readily. When the lubricating oil vaporizes, the amount of the lubricating oil inside the shock absorber decreases and therefore the damping force to be caused by the bottom valve could not be generated and the riding comfort of automobiles would be thereby extremely worsened.

On the other hand, when the viscosity index of lubricating oil is increased so as to suppress the viscosity reduction at high temperatures, the shear stability of the lubricating oil tends to worsen. In the case where the lubricating oil of the type is used, the viscosity of the lubricating oil would gradually lower owing to the actuation of shock absorber and the damping force could not be generated well and, as a result, the riding comfort of automobiles is worsened.

PTLs 1 and 2 describe a lubricating oil composition for a shock absorber using a mineral oil whose pour point is −30° C. or lower. Regarding the lubricating oil composition for a shock absorber in PTLs 1 and 2, however, the Brookfield viscosity thereof at −40° C. is more than 1,000 mPa·s (Examples), and therefore the lubricating oil composition could not sufficiently improve riding comfort at low temperatures.

PTL 1: JP 2000-109876 A
PTL 2: JP 2000-109877 A

DISCLOSURE OF INVENTION

Technical Problem

Given the situation, the present invention is to provide a lubricating oil composition for a shock absorber, which realizes excellent riding comfort in low-temperature and high-temperature environments and can suppress worsening of riding comfort with time, which is caused by evaporation and shearing of the lubricating oil.

Solution to Problem

For solving the above-mentioned problems, the present invention provides a lubricating oil composition for a shock absorber of the following [1] to [9].

[1] A lubricating oil composition for a shock absorber, containing (A) a base oil having a pour point of lower than −40° C. and a kinematic viscosity at 80° C. of from 2.0 to 2.7 $mm^2/s$, (B-1) from 1 to 15% by mass of a polymethacrylate having a weight-average molecular weight of from 10,000 to less than 100,000, and (B-2) from 0.1 to 5% by mass of a polymethacrylate having a weight-average molecular weight of from 100,000 to 200,000.

[2] The lubricating oil composition for a shock absorber according to the above [1], wherein the density at 15° C. of the base oil of the component (A) is from 0.80 to 0.83 $g/cm^3$.

[3] The lubricating oil composition for a shock absorber according to the above [1] or [2], which contains from 1.1 to 20% by mass in a total amount of the component (B-1) and the component (B-2) in the lubricating oil composition for a shock absorber.

[4] The lubricating oil composition for a shock absorber according to any of the above [1] to [3], wherein the polymethacrylate of the component (B-1) and/or the component (B-2) is a nondispersive polymethacrylate.

[5] The lubricating oil composition for a shock absorber according to any of the above [1] to [4], wherein the NOACK value at 150° C. of the lubricating oil composition for a shock absorber is 12% by mass or less.

[6] The lubricating oil composition for a shock absorber according to any of the above [1] to [5], wherein the Brookfield viscosity at −40° C. of the lubricating oil composition for a shock absorber is 700 mPa·s or less.

[7] The lubricating oil composition for a shock absorber according to any of the above [1] to [6], wherein the viscosity reduction rate in the shearing stability test of the lubricating oil composition for a shock absorber according to an ultrasonic method is 18% or less.

[8] The lubricating oil composition for a shock absorber according to any of the above [1] to [7], wherein the high-temperature high-shear viscosity at 80° C. of the lubricating oil composition for a shock absorber is 4.2 mPa·s or more.

[9] The lubricating oil composition for a shock absorber according to any of the above [1] to [8], which is for use in cars.

Advantageous Effects of Invention

The lubricating oil composition for a shock absorber of the present invention realizes excellent riding comfort in low-temperature and high-temperature environments and can suppress worsening of riding comfort with time, which is caused by evaporation and shearing of the lubricating oil.

DESCRIPTION OF BEST EMBODIMENTS

The lubricating oil composition for a shock absorber of the present invention contains (A) a base oil having a pour point of lower than −40° C. and a kinematic viscosity at 80° C. of from 2.0 to 2.7 $mm^2/s$, (B-1) from 1 to 15% by mass of a polymethacrylate having a weight-average molecular weight of from 10,000 to less than 100,000, and (B-2) from 1 to 5% by mass of a polymethacrylate having a weight-average molecular weight of from 100,000 to 200,000.

[(A) Base Oil]

The lubricating oil composition for a shock absorber of the present invention contains, as the component (A), a base oil having a pour point of lower than −40° C. and a kinematic viscosity at 80° C. of from 2.0 to 2.7 $mm^2/s$, When the pour point of the base oil is −40° C. or higher, the flowability of the base oil lowers in low-temperature environments thereby failing in generation of the damping force of a shock absorber and thereby worsening riding comfort.

When the kinematic viscosity at 80° C. of the base oil is lower than 2.0 $mm^2/s$, the base oil tends to readily evaporate so that the oil amount would decrease with time and the damping force of a shock absorber would weaken thereby worsening riding comfort. In addition, when the kinematic viscosity at 80° C. of the base oil is lower than 2.0 $mm^2/s$, the damping force of a shock absorber would weaken and therefore the riding comfort in high-temperature environments could not be bettered.

When the kinematic viscosity at 80° C. of the base oil is higher than 2.7 $mm^2/s$, the flowability of the base oil in low-temperature environment lowers thereby failing in generation of the damping force of a shock absorber and thereby worsening riding comfort.

The pour point of the base oil of the component (A) is preferably −45° C. or lower. The kinematic viscosity at 80° C. of the base oil of the component (A) is preferably from 2.1 to 2.6 $mm^2/s$, more preferably from 2.2 to 2.4 $mm^2/s$.

As the base oil of the component (A), usable are mineral oil and/or synthetic oil.

Examples of the mineral oil include paraffin-based mineral oil, intermediate-based mineral oil, naphthene-based mineral oil and the like, which are obtained by usual refining processes such as solvent refining, hydrorefining or the like, those prepared by isomerizing wax produced through Fischer-Tropsch process or the like (gas-to-liquid wax) or mineral oil-based wax, and the like.

Examples of the synthetic oil include hydrocarbon synthetic oil, ether synthetic oil, etc. As examples of the hydrocarbon synthetic oil, there are mentioned α-olefin oligomers such as polybutene, polyisobutylene, 1-octene oligomer, 1-decene oligomer, ethylene-propylene copolymer, etc. and hydrides thereof; alkylbenzene, alkylnaphthalene, etc. Examples of the ether synthetic oil include polyoxyalkylene glycol, polyphenyl ether, etc.

The base oil of the component (A) may be a single-system oil of one alone of the above-mentioned mineral oil and synthetic oil, or may also be a mixed-system oil prepared by mixing two or more types of the mineral oil, or two or more types of the synthetic oil, or one or more types of both the mineral oil and the synthetic oil. In the case where the base oil of the component (A) is a mixture of two or more types of the oil, it is desirable that the mixture does not substantially contain a mineral oil or a synthetic oil whose kinematic viscosity at 80° C. is 1.2 $mm^2/s$ or less. This is because when the mixed system contains a base oil whose kinematic viscosity at 80° C. is 1.2 $mm^2/s$ or less, the base oil could hardly be prevented from evaporating even though the kinematic viscosity at 80° C. of the mixed base oil satisfies the range of the present invention. Here, "does not substantially contain" means that the amount is 1% by mass or less of the total amount of the base oil of the component (A), preferably 0.1% by mass or less, and more preferably, the amount is 0% by mass.

In the present invention, when the base oil of the component (A) is the above-mentioned mixed system, the physical properties (kinematic viscosity, density, pour point, viscosity index, distillation characteristics) of the base oil are those of the mixed base oil, unless otherwise specifically indicated.

The base oil of the component (A) may be any of mineral oil or synthetic oil having a pour point of lower than −40° C. and a kinematic viscosity at 80° C. of from 2.0 to 2.7 $mm^2/s$, but from the viewpoint of the solubility of additives therein, preferred is mineral oil.

Preferably, the density at 15° C. of the base oil of the component (A) is from 0.80 to 0.83 $g/cm^3$, from the viewpoint of generating suitable damping force.

The content ratio of the base oil of the component (A) in the total amount of the lubricating oil composition for a shock absorber is preferably from 80 to 99% by mass, more preferably from 85 to 95% by mass.

[(B) Polymethacrylate]

The lubricating oil composition for a shock absorber of the present invention contains (B-1) from 1 to 15% by mass of a polymethacrylate having a weight-average molecular weight of from 10,000 to less than 100,000 (hereinafter this may be referred to as "polymethacrylate 1"), and (B-2) from 0.1 to 5% by mass of a polymethacrylate having a weight-average molecular weight of from 100,000 to 200,000 (hereinafter this may be referred to as "polymethacrylate 2").

The weight-average molecular weight may be measured, for example, through size exclusion chromatography. A system using the technology is, for example, Prominence GPC System manufactured by Shimadzu Corporation.

Polymethacrylate is roughly classified into a dispersive one and a non-dispersive one. As the polymethacrylate 1 and the polymethacrylate 2, both those two are employable, but from the viewpoint of preventing local seizing, a nondispersive one is preferred.

The kinematic viscosity at 80° C. of the base oil of the component (A), which is the main component in the lubricating oil composition for a shock absorber of the present invention, is defined to be low in order to prevent viscosity increase in low-temperature environments. Accordingly, it is important to add polymethacrylate so as to increase the viscosity in a high-temperature region of the lubricating oil composition for the purpose of giving suitable clamping force to a shock absorber to better riding comfort in a high-temperature region. However, in the lubricating oil composition for a shock absorber of the present invention, the viscosity of the base oil of the main component is low and therefore, when a polymethacrylate having a high molecular weight is merely added, the viscosity reduction owing to shearing of polymethacrylate is more significant than usual and the riding comfort would be rapidly lost. Regarding the viscosity reduction owing to shearing, not only permanent viscosity reduction owing to mechanical shearing but also temporal viscosity reduction at a high shear rate would provide some problem.

Accordingly, the lubricating oil composition for a shock absorber of the present invention is made to contain from 1 to 15% by mass of the polymethacrylate 1 as the component (B-1) and from 0.1 to 5% by mass of the polymethacrylate 2 as the component (B-2), in addition to the above-mentioned base oil of the component (A), so as to make a shock absorber generate suitable damping force by increasing the viscosity in a high-temperature region of the lubricating oil composition and to prevent viscosity reduction (permanent viscosity reduction and temporal viscosity reduction) owing to shearing of polymethacrylate and further to prevent crystallization of the wax component contained in the base oil of the component (A) in a low-temperature environments to prevent viscosity increase in low-temperature environments, thereby making it possible to maintain good riding comfort.

The content of the polymethacrylate 1 of the component (B-1) is preferably from 2 to 13% by mass in the lubricating oil composition for a shock absorber, more preferably from 4 to 10% by mass. The content of polymethacrylate 2 of the component (B-2) is preferably from 0.5 to 4% by mass in the lubricating oil composition for a shock absorber, more preferably from 1 to 3% by mass.

In the lubricating oil composition for a shock absorber, the total content of the polymethacrylate 1 of the component (B-1) and the polymethacrylate 2 of the component (B-2) is preferably from 1.1 to 20% by mass, more preferably from 5 to 13% by mass. When the total content of the polymethacrylates 1 and 2 is 1.1% by mass or more, the viscosity in a high-temperature region of the lubricating oil composition can be kept high and the crystallization of the wax component contained in the base oil of the component (A) in low-temperature environments can be prevented so that the viscosity increase in a low-temperature region can be prevented and a shock absorber can be thereby made to generate suitable damping force to better riding comfort. When the total content of the polymethacrylates 1 and 2 is 20% by mass or less, the viscosity reduction (permanent viscosity reduction and temporal viscosity reduction) owing to shearing of the polymethacrylates can be prevented and thereby rapid worsening of riding comfort can be prevented.

Preferably, the weight-average molecular weight of the polymethacrylate 1 of the component (B-1) is from 10,000 to 50,000. Also preferably, the weight-average molecular weight of the polymethacrylate 2 of the component (B-2) is from 120,000 to 150,000.

[Friction Reducer]

Preferably, the lubricating oil composition for a shock absorber of the present invention contains a friction reducer for the purpose of reducing the friction to occur inside a shock absorber, such as friction to occur in a bronze bush (bearing in the slide part between cylinder and piston rod).

Examples of the friction reducer include (C) phosphorus acid esters and (D) primary amines, etc.

Examples of the phosphorus acid ester of the component (C) include orthophosphoric acid esters, acidic phosphoric acid esters and phosphorous acid esters, and at least one of these may be used. The phosphorus acid ester is especially excellent in the friction-reducing effect for bronze bushes. Of those phosphorus acid esters, preferred are acidic phosphoric acid esters. More preferred is use of a mixture of an orthophosphoric acid ester, an acidic phosphoric acid ester and a phosphorous acid ester.

As the orthophosphoric acid ester, for example, usable are those shown by the following formula (I):

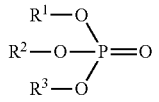

(I)

In the general formula (I), $R^1$ to $R^3$ each represent an alkyl group having from 4 to 24 carbon atoms or an alkenyl group having from 4 to 24 carbon atoms.

The alkyl group and the alkenyl group for $R^1$ to $R^3$ may be any of linear, branched or cyclic ones, but preferred are linear ones. Further, the alkyl group and the alkenyl group for $R^1$ to $R^3$ preferably have from 6 to 20 carbon atoms each, more preferably 7 carbon atoms.

Examples of the alkyl group of $R^1$ to $R^3$ include an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group and a tetracosyl group, and these may be any of linear, branched or cyclic ones. Examples of the alkenyl group include an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group and a tetracosenyl group, and these may be any of linear, branched or cyclic ones, and the double bond may be at any position therein.

As the acidic phosphoric acid ester, for example, usable are those shown by the following formula (II):

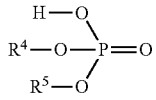

(II)

In the general formula (II), $R^4$ represents a hydrogen atom, an alkyl group having from 8 to 24 carbon atoms or an alkenyl group having from 8 to 24 carbon atoms, and among these, an alkyl group or an alkenyl group is preferred. $R^5$ represents an alkyl group having from 8 to 24 carbon atoms or an alkenyl group having from 8 to 24 carbon atoms.

The alkyl group and the alkenyl group for $R^4$ and $R^5$ may be any of linear, branched or cyclic ones, but are preferably linear. Further, the alkyl group and the alkenyl group for $R^4$ and $R^5$ preferably have from 12 to 24 carbon atoms, more preferably from 16 to 20 carbon atoms, even more preferably 18 carbon atoms.

Specific examples of the alkyl group and the alkenyl group for $R^4$ and $R^5$ are the same as those for $R^1$ to $R^3$.

As the acidic phosphorous acid ester, for example, usable are those shown by the following formula (III):

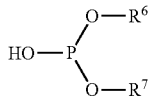

(III)

In the general formula (III), $R^6$ represents a hydrogen atom, an alkyl group having from 8 to 24 carbon atoms or an alkenyl group having from 8 to 24 carbon atoms, and among these, an alkyl group or an alkenyl group is preferred. $R^7$ represents an alkyl group having from 8 to 24 carbon atoms or an alkenyl group having from 8 to 24 carbon atoms.

The alkyl group and the alkenyl group for $R^6$ and $R^7$ may be any of linear, branched or cyclic ones, but are preferably linear. Further, the alkyl group and the alkenyl group for $R^6$ and $R^7$ preferably have from 8 to 20 carbon atoms, more preferably from 10 to 16 carbon atoms, even more preferably 12 carbon atoms.

Specific examples of the alkyl group and the alkenyl group for $R^6$ and $R^7$ are the same as those for $R^1$ to $R^3$.

The content of the phosphorus acid ester of the component (C) is, from the viewpoint of reducing friction and preventing formation of an undissolved matter, preferably from 0.1 to 3% by mass relative to the total amount of the lubricating oil composition for a shock absorber, more preferably from 0.8 to 2% by mass.

The primary amine of the component (D) is preferably one in which the alkyl group has from 6 to 20 carbon atoms, more preferably from 12 to 20 carbon atoms, even more preferably 18 carbon atoms. The primary amine is especially excellent in the friction-reducing effect for bronze bushes.

Examples of the primary amine include monohexylamine, monocyclohexylamine, monooctylamine, monolaurylamine, monostearylamine and monooleylamine. One alone or two or more of these primary amines may be used either singly or as combined.

One or more types of primary amines of the component (D) may be used. Among such primary amines, one in which the alkyl group has from 6 to 20 carbon atoms is preferably used as the main component, and more preferred as the main component is one in which the alkyl group has from 12 to 20 carbon atoms, and even more preferred as the main component is one in which the alkyl group has 18 carbon atoms. The wording "as the main component" means that the main component is preferably 50% by mass or more of the total amount of the primary amine of the component (D), more preferably 80% by mass or more, even more preferably 90% by mass or more.

The content of the primary amine of the component (D) is, from the viewpoint of reducing friction and preventing formation of an undissolved matter, preferably from 0.01 to 1% by mass relative to the total amount of the lubricating oil composition for a shock absorber, more preferably from 0.02 to 0.1% by mass.

[Optional Additive Component]

The shock absorber oil of the present invention can suitably contain, as an optional additive component (E), at least one selected from ash-less detergent-dispersants, metal-based detergents, lubricity improvers, antioxidants, rust preventive agents, metal deactivators, and antifoaming agents, within a range not detracting from the object of the present invention.

The content ratio of the optional additive component (E) in the total amount of the lubricating oil composition for a shock absorber is, in general, preferably 5% by mass or less, more preferably from 0.5 to 3% by mass.

Examples of the ash-less detergent-dispersant include succinimides, boron-containing succinimides, benzylamines, boron-containing benzylamines, bivalent carboxylic amides typified by those with succinic acid. Examples of the metal-based detergent include neutral metal sulfonates, neutral metal phenates, neutral metal salicylates, neutral metal phosphonates, basic sulfonates, basic phenates, basic salicylates, overbased sulfonates, overbased salicylates, overbased phosphonates, etc.

As the lubricity improver, extreme pressure agents, antifriction agents, and oiliness agents are mentioned. For example, there are mentioned phosphorus-containing ester compounds such as phosphates, amine salts of acidic phosphoric monoesters, acidic phosphorous diesters, etc.; organic metal compounds such as zinc dithiocarbamate (ZnDTC), oxymolybdenum organo-phosphorodithioate sulfide (MoDTP), oxymolybdenum dithiocarbamate sulfide (MoDTC), etc.

Moreover, sulfur-based extreme pressure agents such as sulfurized oils, sulfurized fatty acids, sulfurized esters, sulfurized olefins, dihydrocarbyl polysulfides, thiadiazole compounds, alkylthiocarbamoyl compounds, triazine compounds, thioterpene compounds, dialkyl thiodipropionate compounds and the like are mentioned.

In addition, examples of the oiliness agent include aliphatic saturated and unsaturated monocarboxylic acids such as stearic acid, oleic acid, etc.; polymerized fatty acids such as dimer acid, hydrogenated dimer acid, etc.; hydroxy fatty acids such as ricinoleic acid, 12-hydroxystearic acid, etc.; aliphatic saturated and unsaturated monohydric alcohols such as lauryl alcohol, oleyl alcohol, etc.; aliphatic saturated and unsaturated monoamines such as stearyl amine, oleylamine, etc.; aliphatic saturated and unsaturated monocarboxylic acid amides such as lauric acid amide, oleic acid amide, etc.

Examples of the antioxidant include polycyclic phenolic antioxidants such as 4,4'-methylenebis(2,6-di-tert-butylphenyl, 2,2'-methylenebis(4-ethyl-6-tert-butylphenol), etc.; amine-based antioxidants including monoalkyldiphenylamines compounds such as monooctyldiphenylamine, monononyldiphenylamine, etc., dialkyldiphenylamines compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, etc., polyalkyldiphenylamines compounds such as tetrabutyldiphenylamine, tetrahexyldiphenylamine, tetraoctyldiphenylamine, tetranonyldiphenylamine, etc., and naphthylamine compounds such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, etc.; and sulfur-containing antioxidants such as 2,6-di-tert-butyl-4-(4,6-bis(octylthio)-1,3,5-triazin-2-ylamino)phenol, thioterpene compounds including a reaction product of phosphorus pentasulfide and pinene, etc., dialkyl thiodipropionates including dilauroylthio dipropionate, distearyl thiodipropionate, etc.

Examples of the rust preventive agent include metal sulfonates, succinates, etc. Examples of the metal deactivator include benzotriazole, thiadiazole, etc.

As the antifoaming agent, preferred are high-molecular-weight silicone antifoaming agents. By incorporating the high-molecular-weight silicone antifoaming agent, the antifoaming ability is effectively demonstrated and the riding comfort is improved. As the high-molecular-weight silicone antifoaming agents, for example, organopolysiloxane can be mentioned, and fluorine-containing organopolysiloxanes such as trifluoropropylmethyl silicone oil are particularly preferable.

[Lubricating Oil Composition for Shock Absorber]

Regarding the lubricating oil composition for a shock absorber of the present invention, the NOACK value at 150° C. thereof is, from the viewpoint of preventing the reduction in the oil amount with time, preferably 12% by mass or less, more preferably 10% by mass or less. The NOACK value is an index of indicating vaporizability, and is measured according to ASTM D5800.

In addition, regarding the lubricating oil composition for a shock absorber of the present invention, the Brookfield viscosity (BF viscosity) thereof at −40° C. is, from the viewpoint of securing the damping force in low-temperature environments, preferably 700 mPa·s or less, more preferably 650 mPa·s or less, even more preferably 600 mPa·s or less.

In addition, regarding the lubricating oil composition for a shock absorber of the present invention, the viscosity reduction rate in the shearing stability test thereof according to an ultrasonic method is, from the viewpoint of preventing the riding comfort from worsening owing to permanent viscosity reduction, preferably 18% or less, more preferably 16% or less.

The viscosity reduction rate in the shearing stability test was calculated according to the following equation, in which the kinematic viscosity at 40° C. was measured before and after the shearing test according to JIS K2283. The shearing test was carried out according to the ultrasonic wave method A (JPI-5S-29). The measurement conditions were: ultrasonic wave irradiation time 60 minutes, room temperature, oil amount 30 cc. The output voltage for the ultrasonic waves in the shearing stability test was such an output voltage that after 30 cc of a reference oil was irradiated with ultrasonic waves at the output voltage for 10 minutes, the reduction rate in the kinematic viscosity at 40° C. was 25%.

Shear Stability=([kinematic viscosity before test]−[kinematic viscosity after test]/[kinematic viscosity before test])×100

In addition, regarding the lubricating oil composition for a shock absorber of the present invention, the high-temperature high-shear viscosity at 80° C. (TBS viscosity) thereof is, from the viewpoint of preventing the riding comfort from worsening owing to temporal viscosity reduction, preferably 4.2 mPa·s or more.

The high-temperature high-shear viscosity is one measured according to ASTM D4683 and using a TBS viscometer, under the condition at 80° C. and at a shear rate of $10^6$/s.

When the lubricating oil composition for a shock absorber of the present invention is used for a shock absorber for cars and the like, it realizes excellent riding comfort in low-temperature and high-temperature environments and can suppress worsening of riding comfort with time, which is caused by evaporation and shearing of the lubricating oil.

The lubricating oil composition for a shock absorber of the present invention can be used in any of a multi-cylinder shock absorber or a single-cylinder absorber, and can be used in a shock absorber for any of cars or motorcycles, but is especially preferred for cars.

EXAMPLES

Next, the present invention is described in more detail by Examples, but the present invention is not whatsoever restricted by these Examples.

Various measurements were carried out according to the following methods.

1. Kinematic Viscosity

According to JIS K2283, the kinematic viscosity at 80° C. was measured.

2. Pour Point

According to JIS K2269, the pour point was measured.

3. Brookfield Viscosity (BF Viscosity)

According to ASTM D2983, the Brookfield viscosity at −40° C. was measured.

4. High-Temperature High-Shear Viscosity (TBS Viscosity, 80° C.)

According to ASTM D4683 and using a TBS viscometer, the viscosity was measured at 80° C. and at a shear rate of $10^6$/s.

5. Shearing Stability

According to JIS K2283, the kinematic viscosity at 40° C. was measured before and after the shearing test, and the shearing stability was calculated according to the following equation. The shearing test was carried out on the basis of an ultrasonic wave method A (JPI-5S-29). Regarding the measurement conditions, the ultrasonic wave irradiation time was 60 minutes, the temperature was room temperature and the oil amount was 30 cc. The output voltage for the ultrasonic waves in the shearing stability test was such an output voltage that after 30 cc of a reference oil was irradiated with ultrasonic waves at the output voltage for 10 minutes, the reduction rate in the kinematic viscosity at 40° C. was 25%.

Shear Stability=([kinematic viscosity before test]−[kinematic viscosity after test]/[kinematic viscosity before test])×100

6. NOACK Test

According to ASTM D5800, the NOACK value at 150° C. was calculated.

7. Friction Coefficient to Bronze

Using a Bowden type reciprocating friction tester, the dynamic friction coefficient (μd) and the static friction coefficient (μs) to bronze were measured under the following test conditions. In addition, the μ ratio (μs/μd) was also calculated.

Temperature: 60° C.

Rate: 0.3 mm/s

Amplitude: 10 mm

Test piece: phosphor-bronze ball (ball having a diameter of 12.7 mm)/chromium-plated plate (50×1,000×5 mm)

Load: 5 kgf

Number of Friction: 1

A few drops of a sample oil were put onto the plate, running-in operation (20 mm/s×2 minutes) was performed, and then the test was performed.

Base oils containing the mineral oil and the synthetic oil as shown in Table 1 and Table 2 were prepared. The kinematic viscosity at 80° C., the pour point and the density at 15° C. of each of the base oils are shown in Table 1 and Table 2.

TABLE 1

| | Base Oil 1 | Base Oil 2 | Base Oil 3 | Base Oil 4 | Base Oil 5 | Base Oil 6 | Base Oil 7 | Base Oil 8 |
|---|---|---|---|---|---|---|---|---|
| Mineral Oil A | 16.00 | 18.00 | 20.00 | 20.00 | — | — | 30.00 | — |
| Mineral Oil B | 72.84 | 70.51 | 67.44 | — | — | — | — | — |
| Mineral Oil C | — | — | — | 51.90 | 40.00 | 30.00 | 56.90 | — |
| Mineral Oil D | — | — | — | — | 46.90 | 56.90 | | — |
| Mineral Oil E | — | — | — | — | — | — | — | 51.90 |
| Mineral Oil F | — | — | — | — | — | — | — | 35.00 |
| Mineral Oil G | — | — | — | — | — | — | — | — |
| Mineral Oil H | — | — | — | — | — | — | — | — |
| Synthetic Oil A | — | — | — | 15.00 | — | — | — | — |
| Synthetic Oil B | — | — | — | — | — | — | — | — |

TABLE 1-continued

| | Base Oil 1 | Base Oil 2 | Base Oil 3 | Base Oil 4 | Base Oil 5 | Base Oil 6 | Base Oil 7 | Base Oil 8 |
|---|---|---|---|---|---|---|---|---|
| Synthetic Oil C | — | — | — | — | — | — | — | — |
| Synthetic Oil D | — | — | — | — | — | — | — | — |
| Kinematic Viscosity at 80° C. ($mm^2/s$) | 2.25 | 2.22 | 2.17 | 1.81 | 1.72 | 1.68 | 1.66 | 1.91 |
| Pour Point (° C.) | −50 | −50 | −50 or lower | −25 | −25 | −25 | −40 | −37.5 |
| Density at 15° C. ($g/cm^3$) | 0.8193 | 0.8192 | 0.8191 | 0.8099 | 0.8115 | 0.8115 | 0.8127 | 0.8064 |

TABLE 2

| | Base Oil 9 | Base Oil 10 | Base Oil 11 | Base Oil 12 | Base Oil 13 | Base Oil 14 | Base Oil 15 | Base Oil 16 |
|---|---|---|---|---|---|---|---|---|
| Mineral Oil A | — | — | — | — | — | — | — | — |
| Mineral Oil B | — | — | — | — | — | — | — | — |
| Mineral Oil C | — | — | — | — | — | — | — | — |
| Mineral Oil D | — | — | — | — | — | — | — | — |
| Mineral Oil E | 55.86 | — | — | 35.00 | 40.00 | — | 77.94 | 81.28 |
| Mineral Oil F | 35.00 | 10.00 | 20.00 | | — | — | 15.00 | — |
| Mineral Oil G | — | 70.86 | 59.01 | 55.86 | — | — | — | — |
| Mineral Oil H | — | — | — | — | — | — | — | 15.00 |
| Synthetic Oil A | — | — | — | — | — | — | — | — |
| Synthetic Oil B | — | — | 5.00 | — | — | — | — | — |
| Synthetic Oil C | — | 10.00 | 5.00 | — | — | — | — | — |
| Synthetic Oil D | — | — | — | — | 50.86 | 90.33 | — | — |
| Kinematic Viscosity at 80° C. ($mm^2/s$) | 1.93 | 1.98 | 1.76 | 2.34 | 2.28 | 1.88 | 2.46 | 3.43 |
| Pour Point (° C.) | −37.5 | −32.5 | −32.5 | −30 | −40 | −50 or lower | −37.5 | −30 |
| Density at 15° C. ($g/cm^3$) | 0.8070 | 0.8218 | 0.8164 | 0.8242 | 0.8419 | 0.8600 | 0.8300 | 0.8230 |

Mineral oil A: 80° C. kinematic viscosity; 1.279 $mm^2/s$, 15° C. density; 0.8153 $g/cm^3$, pour point; −50° C. or lower
Mineral oil B: 80° C. kinematic viscosity; 2.615 $mm^2/s$, 15° C. density; 0.8202 $g/cm^3$, pour point; −42.5° C. or lower
Mineral oil C: 80° C. kinematic viscosity; 1.950 $mm^2/s$, 15° C. density; 0.8113 $g/cm^3$, pour point; −17.5° C. or lower
Mineral oil D: 80° C. kinematic viscosity; 1.552 $mm^2/s$, 15° C. density; 0.8116 $g/cm^3$, pour point; −32.5° C. or lower
Mineral oil E: 80° C. kinematic viscosity; 2.976 $mm^2/s$, 15° C. density; 0.8200 $g/cm^3$, pour point; −37.5° C. or lower
Mineral oil F: 80° C. kinematic viscosity; 1.131 $mm^2/s$, 15° C. density; 0.7871 $g/cm^3$, pour point; −37.5° C. or lower
Mineral oil G: 80° C. kinematic viscosity; 2.026 $mm^2/s$, 15° C. density; 0.8269 $g/cm^3$, pour point; −27.5° C. or lower
Mineral oil H: 80° C. kinematic viscosity; 8.634 $mm^2/s$, 15° C. density; 0.8399 $g/cm^3$, pour point; −20° C. or lower
Synthetic oil A: PAO, 80° C. kinematic viscosity; 2.379 $mm^2/s$, 15° C. density; 0.7980 $g/cm^3$, pour point; −70° C.
Synthetic oil B; isoparaffin, 80° C. kinematic viscosity; 1.379 $mm^2/s$, 15° C. density; 0.7850 $g/cm^3$, pour point; −60° C.
Synthetic oil C; ester, 80° C. kinematic viscosity; 3.404 $mm^2/s$, 15° C. density; 0.8930 $g/cm^3$, pour point; −22.5° C. or lower
Synthetic oil D: alkylbenzene, 80° C. kinematic viscosity; 1.884 $mm^2/s$, 15° C. density; 0.8600 $g/cm^3$, pour point; −50° C. or lower

Examples 1 to 3 and Comparative Examples 1 to 13

Lubricating oil compositions for a shock absorber containing the components shown in Table 3 were prepared, and tested for the NOACK value, the 80° C. kinematic viscosity, the BF viscosity and the shear stability thereof. In addition, the TBS viscosity of the oil compositions of Examples 1 to 3 and Comparative Examples 1, 4, 6, 7 and 13 was measured, and the friction coefficient to bronze of the oil compositions of Example 1 and Comparative Examples 5 and 6 was measured. The results are shown in Table 3.

TABLE 3

| | | Example 1 | Example 2 | Example 3 | Comparative Example 1 | Comparative Example 2 | Comparative Example 3 | Comparative Example 4 | Comparative Example 5 |
|---|---|---|---|---|---|---|---|---|---|
| (A) Base Oil | type of base oil | base oil 1 | base oil 2 | base oil 3 | base oil 4 | base oil 5 | base oil 6 | base oil 7 | base oil 8 |
| | 80° C. Kinematic Viscosity | 2.25 | 2.22 | 2.17 | 1.81 | 1.72 | 1.68 | 1.66 | 1.91 |
| | Pour Point (° C.) | −50 | −50 | −50 or less | −25 | −25 | −25 | −40 | −37.5 |
| | Added Amount | 88.84 | 88.51 | 87.44 | 86.90 | 86.90 | 86.90 | 86.90 | 86.90 |
| (B-1) Polymethacrylate (non-dispersive type MW: 29,000) | | — | — | 7.67 | — | — | — | — | — |
| (B-1) Polymethacrylate (non-dispersive type MW: 30,000) | | 6.27 | 6.60 | — | 9.24 | 9.24 | 9.24 | 9.24 | 9.24 |
| (B-2) Polymethacrylate (non-dispersive type MW: 140,000) | | 2.13 | 2.13 | 2.13 | 1.60 | 1.60 | 1.60 | 1.60 | 1.60 |
| (C) Tricresyl phosphate | | 0.60 | 0.60 | 0.60 | 0.60 | 0.60 | 0.60 | 0.60 | 0.60 |

TABLE 3-continued

| | | | | | | | | |
|---|---|---|---|---|---|---|---|---|
| (C) Dioleyl acid phosphate | 0.20 | 0.20 | 0.20 | — | — | — | — | — |
| (C) Dilaurylhydrogen phosphite | 0.18 | 0.18 | 0.18 | 0.18 | 0.18 | 0.18 | 0.18 | 0.18 |
| (D) Monooleylamine | 0.05 | 0.05 | 0.05 | 0.05 | 0.05 | 0.05 | 0.05 | 0.05 |
| (E) Other additive components antioxidant, detergent-dispersant, oiliness agent, phosphorus-sulfur-based extreme pressure agent, metal deactivator, antifoaming agent | 1.73 | 1.73 | 1.73 | 1.43 | 1.43 | 1.43 | 1.43 | 1.43 |
| Total | 100.00 | 100.00 | 100.00 | 100.00 | 100.00 | 100.00 | 100.00 | 100.00 |
| NOACK value (wt %) | 8.0 | 9.0 | 11.0 | 15.8 | 15.4 | 16.7 | 20.0 | 33.1 |
| 80° C. kinematic viscosity $mm^2/s$ | 6.227 | 5.898 | 5.291 | 5.963 | 5.803 | 5.295 | 5.656 | 5.841 |
| BF viscosity(−40° C.) (mPa · s) | 600 | 540 | 520 | 570 | 940 | 1920 | 500 | 450 |
| TBS viscosity (80° C.) (mPa · s) | 4.28 | 4.29 | 4.21 | 4.18 | — | — | 3.97 | — |
| Shearing stability | 15 | 16 | 11 | 9 | 9 | 6 | 9 | 8 |
| bronze μd | 0.104 | — | — | — | — | — | — | 0.123 |
| bronze μs | 0.092 | — | — | — | — | — | — | 0.118 |
| bronze μ ratio (μs/μd) | 0.885 | — | — | — | — | — | — | 0.959 |

| | | Comparative Example 6 | Comparative Example 7 | Comparative Example 8 | Comparative Example 9 | Comparative Example 10 | Comparative Example 11 | Comparative Example 12 | Comparative Example 13 |
|---|---|---|---|---|---|---|---|---|---|
| (A) Base Oil | type of base oil | base oil 9 | base oil 10 | base oil 11 | base oil 12 | base oil 13 | base oil 14 | base oil 15 | base oil 16 |
| | 80° C. Kinematic Viscosity | 1.93 | 1.98 | 1.76 | 2.34 | 2.28 | 1.88 | 2.46 | 3.43 |
| | Pour Point (° C.) | −37.5 | −32.5 | −32.5 | −30 | −40 | −50 or less | −37.5 | −30 |
| | Added Amount | 90.86 | 90.86 | 89.01 | 90.86 | 90.86 | 90.33 | 92.94 | 96.28 |
| (B-1) Polymethacrylate (non-dispersive type MW: 29,000) | | — | — | — | — | — | — | — | — |
| (B-1) Polymethacrylate (non-dispersive type MW: 30,000) | | 5.28 | 5.28 | 6.60 | 5.28 | 5.28 | 5.28 | — | — |
| (B-2) Polymethacrylate (non-dispersive type MW: 140,000) | | 1.60 | 1.60 | 2.13 | 1.60 | 1.60 | 2.13 | 4.80 | 2.24 |
| (C) Tricresyl phosphate | | 0.60 | 0.60 | 0.60 | 0.60 | 0.60 | 0.60 | 0.60 | 0.20 |
| (C) Dioleyl acid phosphate | | — | — | — | — | — | — | — | 0.05 |
| (C) Dilaurylhydrogen phosphite | | 0.18 | 0.18 | 0.18 | 0.18 | 0.18 | 0.18 | 0.18 | 0.30 |
| (D) Monooleylamine | | 0.05 | 0.05 | 0.05 | 0.05 | 0.05 | 0.05 | 0.05 | 0.06 |
| (E) Other additive components antioxidant, detergent-dispersant, oiliness agent, phosphorus-sulfur-based extreme pressure agent, metal deactivator, antifoaming agent | | 1.43 | 1.43 | 1.43 | 1.43 | 1.43 | 1.43 | 1.43 | 0.87 |
| Total | | 100.00 | 100.00 | 100.00 | 100.00 | 100.00 | 100.00 | 100.00 | 100.00 |
| NOACK value (wt %) | | 33.1 | 16.0 | 24.0 | 8.2 | 8.4 | 9.8 | 20.1 | 5.2 |
| 80° C. kinematic viscosity $mm^2/s$ | | 5.841 | 5.193 | 5.889 | 5.776 | 5.477 | 5.647 | 5.347 | 5.105 |
| BF viscosity(−40° C.) (mPa · s) | | 450 | 650 | 640 | 950 | 830 | 900 | 720 | 1120 |
| TBS viscosity (80° C.) (mPa · s) | | 4.48 | 4.45 | — | — | — | — | — | 3.72 |
| Shearing stability | | 8 | 13 | 15 | 12 | 11 | 19 | 21 | 11 |
| bronze μd | | 0.123 | — | — | — | — | — | — | — |
| bronze μs | | 0.134 | — | — | — | — | — | — | — |
| bronze μ ratio (μs/μd) | | 1.089 | — | — | — | — | — | — | — |

As obvious from the results in Table 3, the lubricating oil compositions for a shock absorber of Examples 1 to 3 have a low BF viscosity at −40° C., a high kinematic viscosity at 80° C. and a low NOACK value, and are excellent in shearing stability. From these, it is apparent that the lubricating oil compositions for a shock absorber of Examples 1 to 3 realize excellent riding comfort in low-temperature and high-temperature environments and can suppress worsening of riding comfort with time, which is caused by evaporation and shearing of the lubricating oil. In addition, it is apparent that the lubricating oil compositions for a shock absorber of Examples 1 to 3 have a high TBS viscosity and can suppress worsening of riding comfort, which is caused by temporal viscosity reduction.

On the other hand, the lubricating oil compositions of Comparative Examples 1 to 13 do not satisfy the requirements of the present invention in point of at least any of the pour point of the base oil, the 80° C. kinematic viscosity of the base oil and the two polymethacrylates, and therefore the −40° C. BF viscosity thereof was high, or the 80° C. kinematic viscosity thereof was low, or the NOACK value thereof was high, or the shearing stability of the oil composition was poor. From these, it is apparent that the lubricating oil composition for a shock absorber of Comparative Examples 1 to 13 could not better the riding comfort in low-temperature and high-temperature environments and could not prevent the worsening of riding comfort with time, which is caused by evaporation and shearing of the lubricating oil.

INDUSTRIAL APPLICABILITY

The lubricating oil composition for a shock absorber of the present invention can be used in any of a multi-cylinder shock absorber and a single-cylinder shock absorber, and can be used in a shock absorber for any of cars or motorcycles, but is especially preferred for cars.

The invention claimed is:

1. A lubricating oil composition, comprising:

(A) a base oil having a pour point of lower than −40° C., a kinematic viscosity at 80° C. of from 2.0 to 2.7 $mm^2/s$ and a density at 15° C. of from 0.80 to 0.83 $g/cm^3$;

(B-1) from 1 to 7.67% by mass of a polymethacrylate having a weight-average molecular weight of from 10,000 to less than 50,000; and (B-2) from 0.1 to 5% by mass of a polymethacrylate having a weight-average molecular weight of from 140,000 to 200,000, which comprises from 6.0 to 9.8% by mass in a total amount of the component (B-1) and the component (B-2) in the lubricating oil composition, wherein the lubricating oil composition has a NOACK value of 12 wt % or less; a viscosity reduction rate in the ultrasonic shearing stability test of 18% or less; and a BF viscosity at −40° C. of 600 mPa·s or less.

2. The lubricating oil composition according to claim 1, wherein the polymethacrylate of the component (B-1) and/or the component (B-2) is a nondispersive polymethacrylate.

3. The lubricating oil composition according to claim 1, wherein the high-temperature high-shear viscosity at 80° C. of the lubricating oil composition is 4.2 mPa·s or more.

4. The lubricating oil composition according to claim 1, wherein the composition is suitable for cars.

5. The lubricating oil composition according to claim 1, wherein the total amount of the polymethacrylate (B-1) and the polymethacrylate (B-2) is from 8.4 to 9.8 mass %.

6. The lubricating oil composition according to claim 1, having a NOACK value of 8.0-11.0 wt %.

7. The lubricating oil composition according to claim 1, having a shearing stability of from 11 to 16.

8. The lubricating oil composition according to claim 1, having a BF viscosity at −40° C. of from 520 to 600 mPa·s.

9. The lubricating oil composition according to claim 1, wherein the poymethacrylate (B-1) has a weight average molecular weight of from 10,000 to 30,000.

10. The lubricating oil composition according to claim 1, wherein the base oil is a mineral oil.

11. The lubricating oil composition according to claim 1, having a NOACK value of 8.0-11.0 wt %; a shearing stability of from 11 to 16; a BF viscosity at −40° C. of from 520 to 600 mPa·s; and wherein the polymethacrylate (B-1) has a weight average molecular weight of from 10,000 to 30,000.

12. The lubricating oil composition according to claim 1, wherein the amount of the polymethacrylate (B-1) is from 4 to 10% by mass and the amount of the polymethacrylate (B-2) is from 1 to 3% by mass.

* * * * *